US006614332B2

(12) United States Patent
Yamashita et al.

(10) Patent No.: US 6,614,332 B2
(45) Date of Patent: Sep. 2, 2003

(54) TRANSMISSION LINE, INTEGRATED CIRCUIT, AND TRANSMITTER RECEIVER

(75) Inventors: Sadao Yamashita, Kyoto (JP); Toshiro Hiratsuka, Tokyo-to (JP); Atsushi Saitoh, Muko (JP); Takeshi Okano, Sagamihara (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 10/127,235

(22) Filed: Apr. 19, 2002

(65) Prior Publication Data

US 2002/0175784 A1 Nov. 28, 2002

(30) Foreign Application Priority Data

May 28, 2001 (JP) ..... 2001-158609

(51) Int. Cl.[7] ..... H01P 3/16
(52) U.S. Cl. ..... 333/239; 333/137
(58) Field of Search ..... 333/239, 137, 333/125, 248, 254, 250

(56) References Cited

U.S. PATENT DOCUMENTS 5,861,782 A * 1/1999 Saitoh ..... 333/239
5,982,255 A * 11/1999 Tanizaki et al. ..... 333/239
6,031,433 A * 2/2000 Tanizaki et al. ..... 333/26
6,307,451 B1 * 10/2001 Saitoh et al. ..... 333/239
6,515,562 B1 * 2/2003 Takenoshita et al. ..... 333/248
2002/0093403 A1 * 7/2002 Saitoh et al. ..... 333/250

FOREIGN PATENT DOCUMENTS

JP 6-53711 2/1994
JP 10-75108 3/1998

* cited by examiner

*Primary Examiner*—Benny Lee
*Assistant Examiner*—Joseph Chang
(74) *Attorney, Agent, or Firm*—Dickstein, Shapiro, Morin & Oshinsky, LLP.

(57) ABSTRACT

In a transmission line, protrusions extend in line one after another in a direction perpendicular to the cross section in a part of a dielectric substrate, with a discontinuous portion therebetween. A lower-surface electrode is formed on a main surface of the dielectric substrate provided with the protrusions and on the outer surfaces of the protrusions. An upper-surface electrode is formed on substantially the whole area of the surface opposite to the lower-surface electrode. Further, a plurality of through-holes for connecting the lower-surface electrode and the upper-surface electrode, which are formed on both surfaces of the dielectric substrate, are aligned on both sides of the protrusions along the direction in which the protrusions extend. Also, coplanar lines and a circuit element are mounted on the upper-surface electrode. The coplanar lines are coupled at a predetermined position to a transmission path formed by the protrusions.

20 Claims, 7 Drawing Sheets

| ITEM | VALUE |
|---|---|
| SUBSTRATE PERMITTIVITY | $\varepsilon r = 7.0$ |
| WIDTH OF PROTRUSION | w = 0.55mm |
| HEIGHT OF PROTRUSION | g = 0.60mm |
| THICKNESS OF SUBSTRATE | t = 0.30mm |
| THROUGH-HOLE PITCH | 0.4mm |
| NUMBER OF THROUGH-HOLE-LINES | TWO |

TRANSMISSION LINE, INTEGRATED CIRCUIT, AND TRANSMITTER RECEIVER

BACKGROUND OF THE INVENTION

1. Field of the Invention

The present invention relates to a transmission line formed in a dielectric substrate, an integrated circuit having the dielectric substrate, and a transceiver such as a radar device or a communication device including the integrated circuit.

2. Description of the Related Art

Examples of waveguide-type transmission lines which are integrated with dielectric substrates are disclosed in (1) Japanese Unexamined Patent Application Publication No. 6-53711 and (2) Japanese Unexamined Patent Application Publication No. 10-75108.

According to (1), a dielectric substrate has two or more conductor layers and a plurality of conductive through-holes which are aligned in two lines and which connect the conductor layers. The portion between the two conductor layers and between the two lines of through-holes functions as a waveguide (dielectric-filled waveguide). In a dielectric waveguide line and a wiring substrate according to (2), in addition to the construction of (1), sub-conductor layers are formed between two main conductor layers and on both external sides of via-holes such that the sub-conductor layers are electrically connected to the via-holes.

A surface-electrode circuit is formed on the conductor layers of the dielectric substrate and on a dielectric film formed on the conductor layers, so that the surface-electrode circuit is coupled to the transmission line at a plurality of points. By mounting electronic components on the surface-electrode circuit, an integrated circuit is configured in which the dielectric waveguide line functions as a transmission path of input/output units.

However, in both (1) and (2), the only current path functioning as a wall along the direction perpendicular to the waveguide (and perpendicular to the main surface of the dielectric substrate) is formed by the through-holes or the via-holes. Accordingly, current concentrates at the through-holes or the via-holes and thus conductor loss disadvantageously increases. Further, current flows only in the direction perpendicular to the main surface of the dielectric substrate, not in an oblique direction, due to the through-holes or the via-holes formed in the direction perpendicular to the main surface of the dielectric substrate. In this case, suitable transmission characteristics cannot be obtained, as compared to a common waveguide or dielectric-filled waveguide.

Also, since a signal is directly transmitted from a portion of the dielectric waveguide functioning as an input unit to a portion of the dielectric waveguide functioning as an output unit, the surface-electrode circuit cannot receive the necessary signal. Accordingly, circuit elements mounted on the surface-electrode circuit cannot obtain the required output characteristics.

Further, the signal which is directly transmitted from the input unit to the output unit interferes with an output signal from the surface-electrode circuit, and thus transmission characteristics suitable for an integrated circuit cannot be obtained.

SUMMARY OF THE INVENTION

Accordingly, it is an object of the present invention to provide a waveguide-type transmission line having improved transmission characteristics, the transmission line being formed in a dielectric substrate whose main surface is provided with an electrode circuit for mounting electronic components so as to be integrated, and to provide an integrated circuit and a transmitter-receiver including the transmission line.

In order to achieve the above-described object, a dielectric-waveguide-type transmission line according to the present invention comprises: a dielectric substrate; protrusions provided in line, one after another, on at least one main surface of the dielectric substrate; electrodes formed on both main surfaces of the dielectric substrate and on the outer surfaces of the protrusions; a plurality of through-holes for connecting the electrodes, the plurality of through holes being aligned along both sides of the protrusions; an interrupting unit for dividing the transmission line into transmission line segments to interrupt a transmission signal; and a circuit for coupling the transmission line segments separated by the interrupting unit, the circuit being provided on the other main surface of the dielectric substrate. With this arrangement, a signal carried by the transmission line is also directed through the circuit provided on the main surface of the dielectric substrate, and the signal can be prevented from leaking between the protrusions.

Also, the interrupting unit may comprise a protrusion having a predetermined length and a height which is less than the height of the protrusions. Accordingly, the $TE_{10}$ mode does not transmit between the transmission line segments.

Also, the interrupting unit may comprise a protrusion having a predetermined length and a width which is narrower than the width of the protrusions. Accordingly, the $TE_{01}$ mode does not transmit between the transmission line segments.

The transmission line may further comprise other through-holes for connecting the electrodes, the other through-holes being provided in an area for interrupting the transmission signal. With this arrangement, the transmission of the signal between the transmission line segments can be effectively suppressed.

Also, one of the protrusions at one transmission line segment may have a different height from the other protrusion at the other transmission line segment. Accordingly, leakage of the signal transmitted from the input-side of the transmission path to the output-side of the transmission path can be suppressed even when the frequency of the signal input to the electrode circuit formed on the main surface of the dielectric substrate is different from the frequency of the signal output from the electrode circuit.

Further, an integrated circuit according to the present invention comprises the above-described transmission line, electronic components mounted on the other main surface of the dielectric substrate, and a circuit for connecting the electronic components. With this arrangement, an integrated circuit having excellent input/output characteristics and transmission characteristics can be obtained.

Further, a transmitter-receiver according to the present invention comprises one of the above-described transmission line and the integrated circuit. Accordingly, a transmitter-receiver having excellent transmission characteristics can be provided.

Other features and advantages of the present invention will become apparent from the following description of embodiments of the invention which refers to the accompanying drawings.

BRIEF DESCRIPTION OF THE DRAWINGS

For the purposes of illustrating the invention, there is shown in the drawings a form which is presently preferred, it being understood however, that the invention is not limited to the precise form shown by the drawings, in which.

DESCRIPTION OF EMBODIMENTS OF THE INVENTION

Hereinafter, the configuration of a transmission line according to a first embodiment will be described with reference to FIGS. 1A to 4.

Figure 1A:
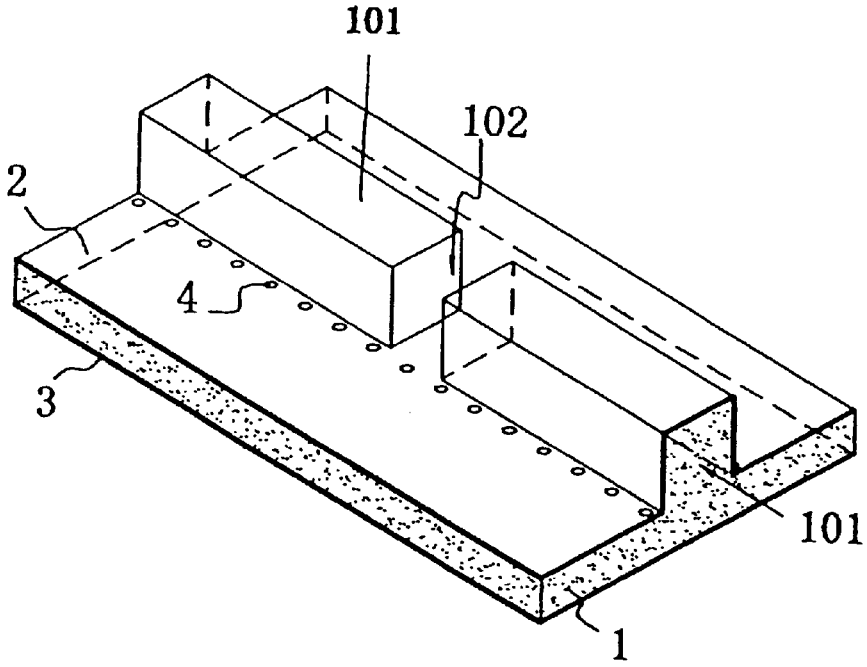
FIGS. 1A and 1B are perspective views of a transmission line according to a first embodiment.
Figure 1B:
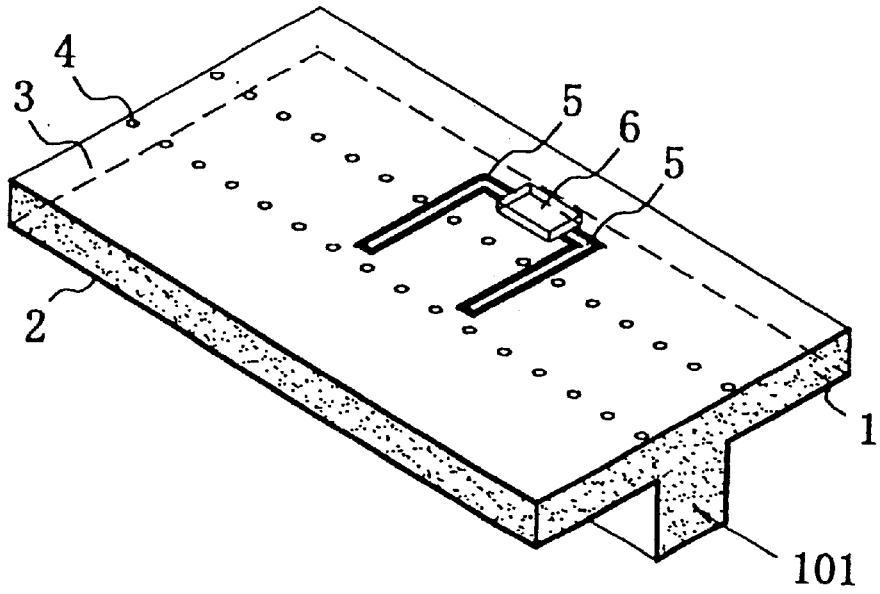

FIGS. 1A and 1B are perspective views of the transmission line wherein FIG. 1A shows a lower side and FIG. 1B shows an upper side.

In FIGS. 1A and 1B, a dielectric substrate 1, a lower-surface electrode 2, an upper-surface electrode 3, through-holes 4, coplanar lines 5, a circuit element 6, protrusions 101, and a discontinuous portion 102 are shown.

The protrusions 101 extend in line one after another in a direction perpendicular to the cross section in a part of the dielectric substrate 1, with the discontinuous portion 102 therebetween. The lower-surface electrode 2 is formed on a main surface of the dielectric substrate 1 provided with the protrusions 101 and on the outer surfaces (side surfaces and upper surface) of the protrusions 101. The upper-surface electrode 3 is formed on substantially the whole area of the surface that is opposite to the lower-surface electrode 2. Further, the plurality of through-holes 4 for connecting the lower-surface electrode 2 and the upper-surface electrode 3, which are formed on both surfaces of the dielectric substrate 1, are aligned on both sides of the protrusions 101 along the direction in which the protrusions 101 extend. Herein, the width of each of the protrusions 101 is ½ or less of the wavelength at an operating frequency in the dielectric substrate 1, and the height, that is, the distance from the upper surface of the dielectric substrate 1 to the lower surface of the protrusions 101 is ½ or more of the wavelength at an operating frequency in the dielectric substrate 1.

In the above-described configuration, the aligned plurality of through-holes 4 equivalently define a wall of a transmission path. Accordingly, electromagnetic waves propagate in a mode similar to the $TE_{10}$ mode, where two mutually opposing side surfaces of the protrusions 101 are defined as H surfaces and the lower surfaces of the protrusions 101 and the upper surface of the dielectric substrate 1 are defined as E surfaces. However, the effective thickness of the transmission path is the thickness of the dielectric substrate 1 at the discontinuous portion 102, where no protrusion exists. Thus, at the discontinuous portion 102, the cut-off frequency of the transmission path increases and thus the electromagnetic waves at the operating frequency are cut off and do not propagate.

On the other hand, as shown in FIG. 1B, the coplanar lines 5 are formed on the upper-surface electrode 3 such that the edges of the coplanar lines 5 are located at positions facing the edges of the protrusions 101, which are separated by the discontinuous portion 102. Also, the circuit element 6 connected to the coplanar lines 5 is mounted on the dielectric substrate 1.

Figure 2:
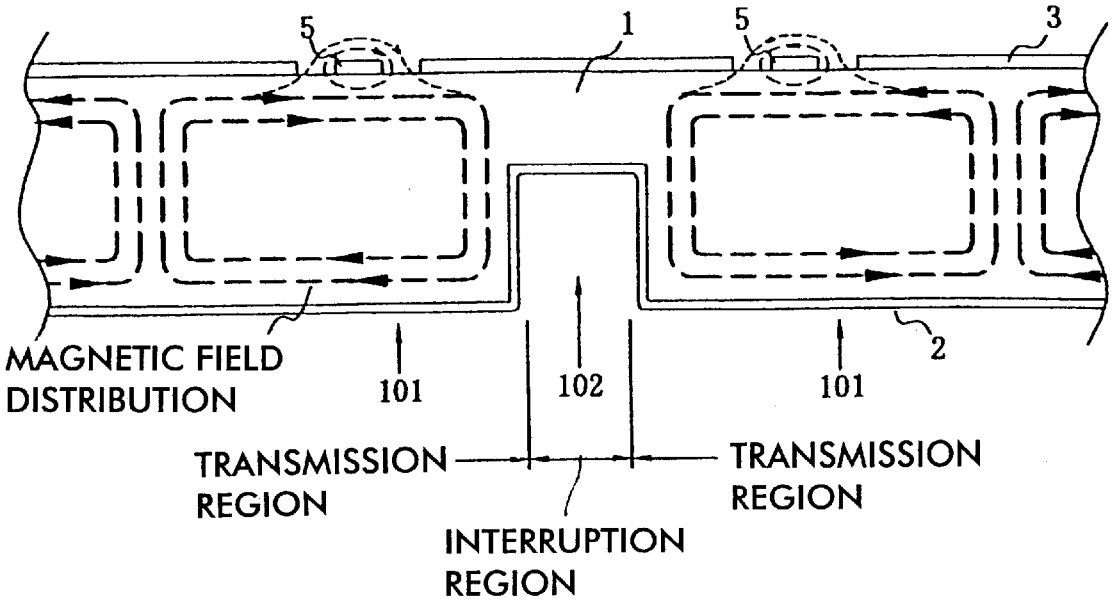
FIG. 2 is a sectional view of the transmission line according to the first embodiment.

FIG. 2 is a sectional view of the dielectric substrate 1 taken along the direction in which the protrusions 101 extend.

In FIG. 2, the dielectric substrate 1, the lower-surface electrode 2, the upper-surface electrode 3, the coplanar lines 5, the protrusions 101, and the discontinuous portion 102 are shown. The broken lines indicate the magnetic field distribution of the $TE_{10}$ mode.

As shown in FIG. 2, electromagnetic fields are induced in the coplanar lines 5 formed on the surface of the dielectric substrate 1 by the $TE_{10}$ mode which propagates through the transmission path formed by the protrusions 101. In this way, the transmission path formed by the protrusions 101 of the dielectric substrate 1 is coupled by the electromagnetic fields to the coplanar lines 5 formed on the upper-surface electrode 3.

Accordingly, the transmission of a signal, which has been transmitted through the transmission path formed by one of the protrusions 101, is interrupted at the discontinuous portion 102, but the signal is transmitted to one of the coplanar lines 5.

Then, the signal transmitted by the coplanar line 5 is input to the circuit element 6 and the circuit element 6 outputs an output signal. The output signal is transmitted from the circuit element 6 through the other coplanar line 5 to the transmission path formed by the other protrusion 101, which is coupled to the coplanar line 5 by the electromagnetic fields, and is output to the external circuit.

For example, when the circuit element 6 is an FET, an amplifier having a simple configuration can be achieved and mounted on the transmission path, by making the transmission path function as input/output terminals.

Herein, due to the existence of the discontinuous portion 102, a large attenuation can be obtained by an isolation characteristic between the input-side of the transmission path and the output-side of the transmission path.

Figures 3A, 3B:
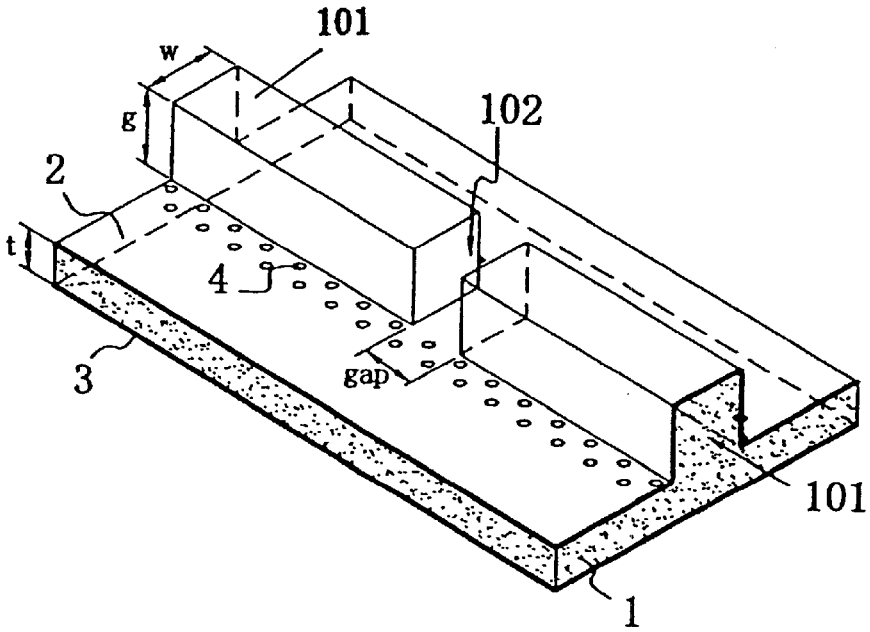
FIG. 3A is a table showing parameters of the transmission line.
FIG. 3B is a perspective view indicating each parameter.

FIG. 3A is a table showing a plurality of parameters of the transmission line, and FIG. 3B is a perspective view indicating each parameter.

Figure 4:
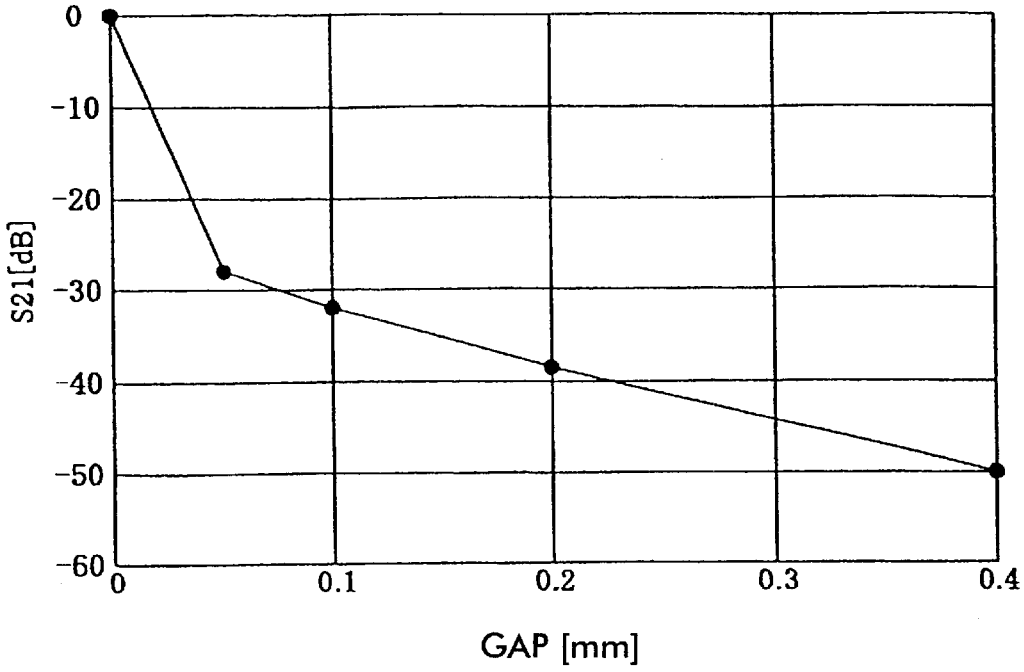
FIG. 4 shows an isolation characteristic of a circuit using the transmission line according to the first embodiment.

FIG. 4 is a diagram showing the isolation characteristic of the circuit when the length of the discontinuous portion (gap) in the transmission line constituted by the parameters shown in FIG. 3A is changed. In this case, the frequency is 76.5 GHz.

As shown in FIG. 4, the isolation characteristic is improved as the length of the discontinuous portion (gap) increases.

In this way, a large attenuation can be obtained by increasing the gap. Therefore, for example, abnormal oscillation due to positive feedback can be prevented if the circuit element is an amplifier having a large gain, and thus an amplifier having a large amplification factor can be easily achieved.

Subsequently, the configuration of a transmission line according to a second embodiment will be described with reference to FIG. 5.

Figure 5:
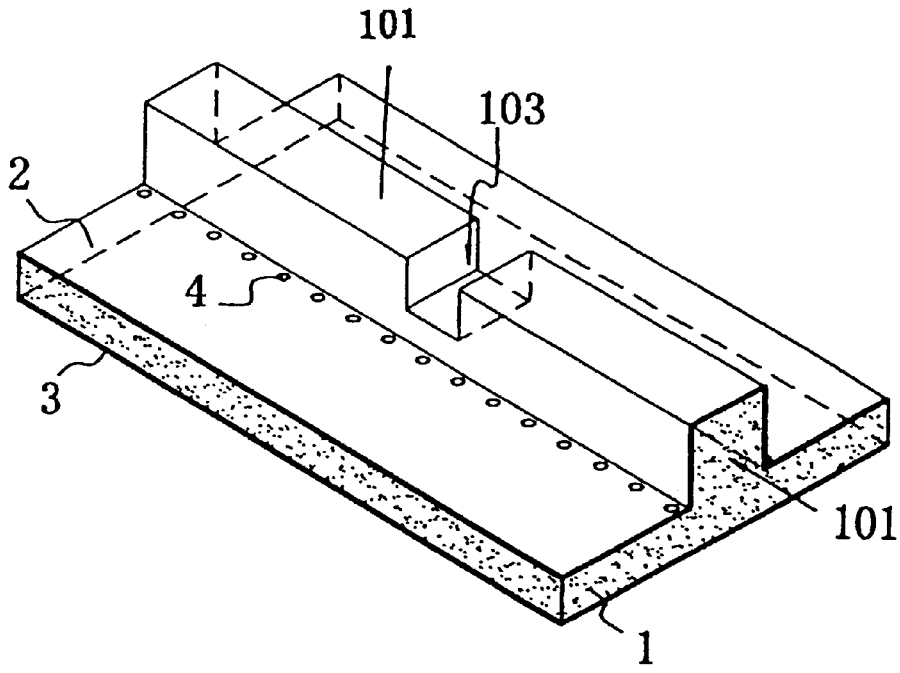
FIG. 5 is a perspective view of a transmission line according to a second embodiment.

FIG. 5 is a perspective view of the transmission line.

In FIG. 5, the dielectric substrate 1, the lower-surface electrode 2, the upper-surface electrode 3, the through-holes 4, the protrusions 101, and a protrusion 103 are shown.

In the transmission line shown in FIG. 5, the protrusion 103, whose height is lower than that of the protrusions 101, is provided between the protrusions 101. The configuration of the transmission line is otherwise the same as the one shown in FIGS. 1A and 1B. The protrusion 103 is formed such that the distance from the upper-surface electrode 3 of the dielectric substrate 1 to the lower surface of the protrusion 103 is shorter than ½ of the wavelength of a transmission signal. Accordingly, the height of the H surface decreases, the cut-off frequency of the transmission path increases, the $TE_{10}$ mode is interrupted at the protrusion 103, and thus electromagnetic waves are not transmitted via the protrusion 103 between the protrusions 101.

According to the above-described configuration, leakage between the transmission paths formed by the protrusions 101 can be suppressed and the isolation characteristic of the circuit including the circuit element mounted on the dielectric substrate and the transmission line can be improved.

Next, the configuration of a transmission line according to a third embodiment will be described with reference to FIG. 6.

Figure 6:
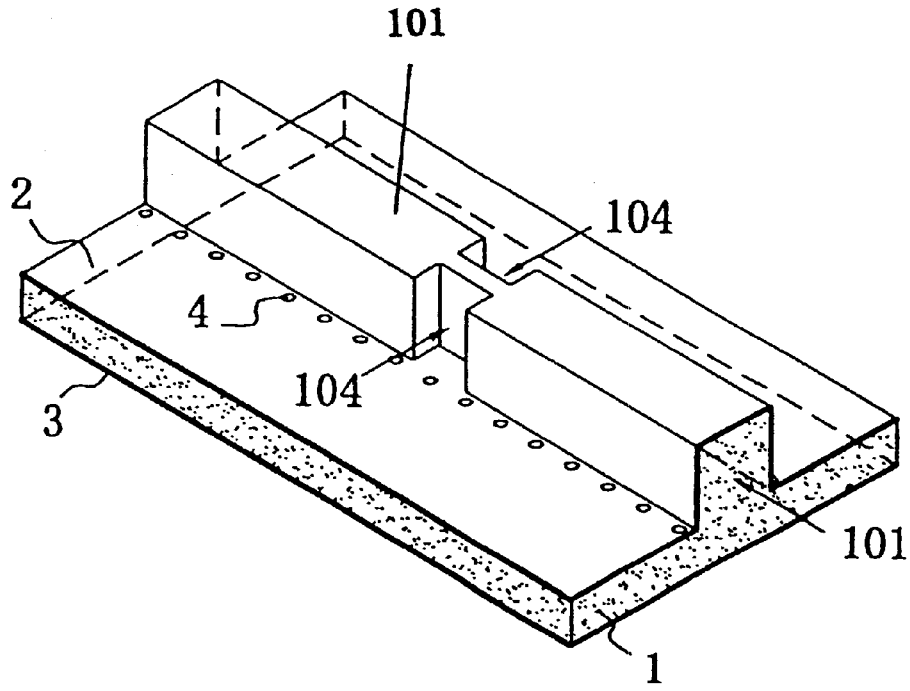
FIG. 6 is a perspective view of a transmission line according to a third embodiment.

FIG. 6 is a perspective view of the transmission line.

In FIG. 6, the dielectric substrate 1, the lower-surface electrode 2, the upper-surface electrode 3, the through-holes 4, the protrusions 101, and indented portions 104 are shown.

In the transmission line shown in FIG. 6, the indented portions 104 are provided between the protrusions 101 which extend one after another, such that the indented portions 104 are recessed at the two sides in the width direction of the protrusions 101. The configuration of the transmission line is otherwise the same as the one shown in FIGS. 1A and 1B.

In this configuration, the operation is the same as that of the transmission line shown in FIG. 5, utilizing the $TE_{10}$ mode in which the electromagnetic fields are turned by 90 degrees. The indented portions 104 contribute to suppress leakage between the protrusions 101, and thus the transmission characteristic of the circuit including the circuit element mounted on the dielectric substrate 1 and the transmission line can be improved.

Next, the configuration of a transmission line according to a fourth embodiment will be described with reference to FIGS. 7A and 7B.

Figure 7A:
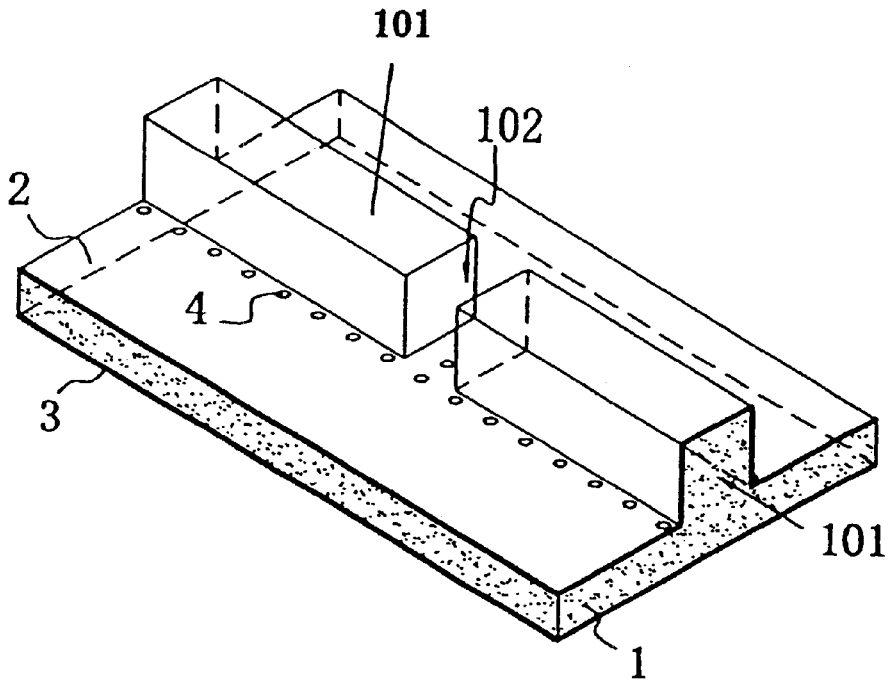
FIGS. 7A and 7B are perspective views of a transmission line according to a fourth embodiment.
Figure 7B:
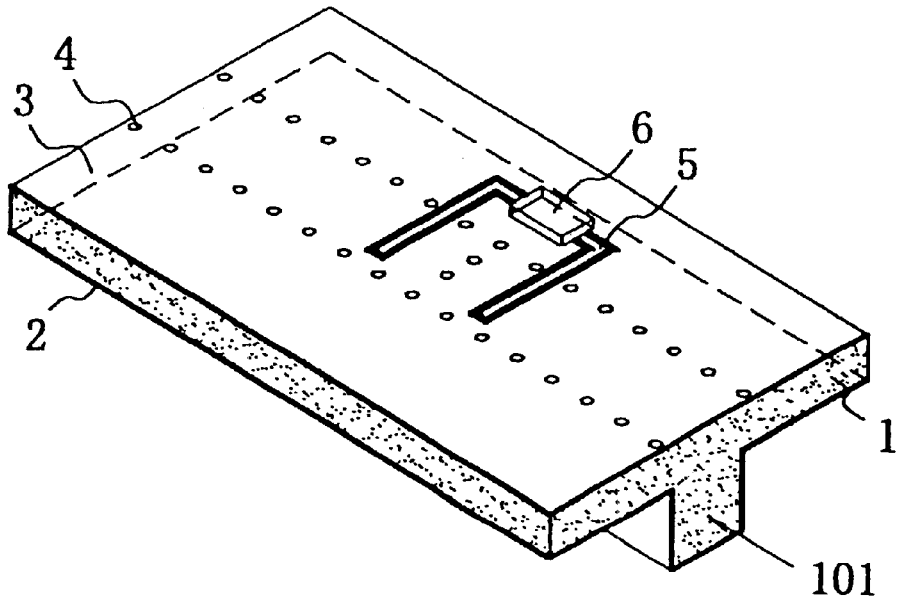

FIGS. 7A and 7B are perspective views of the transmission line.

In FIGS. 7A and 7B, the dielectric substrate 1, the lower-surface electrode 2, the upper-surface electrode 3, the through-holes 4, the protrusions 101, and the discontinuous portion 102 are shown.

In the transmission line shown in FIGS. 7A and 7B, through-holes are also provided in the discontinuous portion 102. The configuration of the transmission line is otherwise the same as the one shown in FIGS. 1A and 1B.

In this configuration, the through-holes 4 provided in the discontinuous portion 102 equivalently function as a conductor wall, and thus the interruption effect of electromagnetic waves can be further improved.

Next, the configuration of a transmission line according to a fifth embodiment will be described with reference to FIG. 8.

Figure 8:
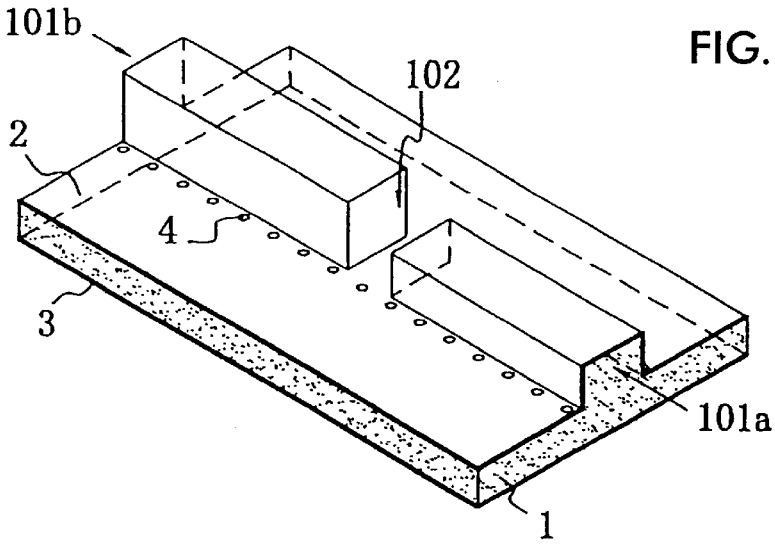
FIG. 8 is a perspective view of a transmission line according to a fifth embodiment.

FIG. 8 is a perspective view of the transmission line.

In FIG. 8, the dielectric substrate 1, the lower-surface electrode 2, the upper-surface electrode 3, the through-holes 4, protrusions 101*a* and 101*b*, and the discontinuous portion 102 are shown.

In the transmission line shown in FIG. 8, the protrusions 101*a* and 101*b*, which are separated by the discontinuous portion 102, have different heights. The configuration of the transmission line is otherwise the same as the one shown in FIGS. 1A and 1B.

In this configuration, different cut-off frequencies can be obtained in the transmission path formed by the protrusion 101*a* and the transmission path formed by the protrusion 101*b*. For example, when the frequency of an input signal is different from that of an output signal in a multiplier or the like, by decreasing the height of the protrusion on the output-side so that the cut-off frequency on the output-side is higher than the frequency of an input signal, leakage of waves directly between the input-side of the transmission path and the output-side of the transmission path can be prevented and transmission of an input signal frequency can be interrupted.

Next, the configuration of a transmission line according to a sixth embodiment will be described with reference to FIG. 9.

Figure 9:
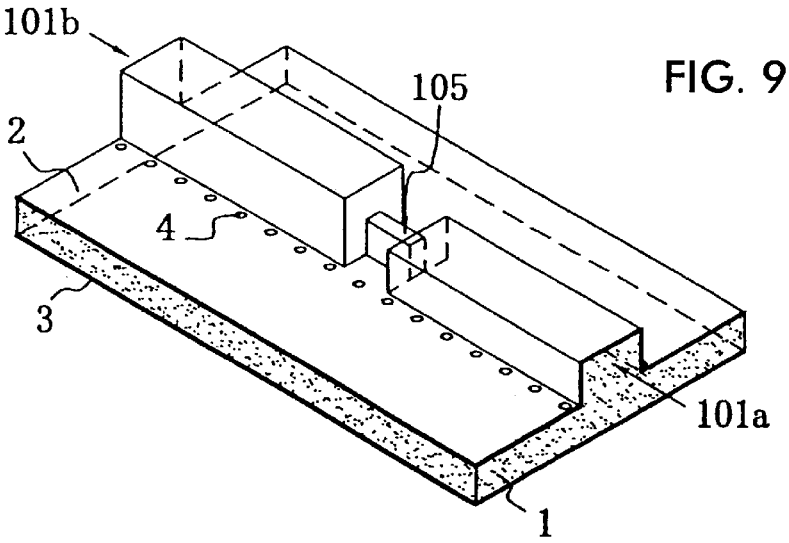
FIG. 9 is a perspective view of a transmission line according to a sixth embodiment.

FIG. 9 is a perspective view of the transmission line.

In FIG. 9, the dielectric substrate 1, the lower-surface electrode 2, the upper-surface electrode 3, the through-holes 4, the protrusions 101*a* and 101*b*, and a protrusion 105 are shown.

In the transmission line shown in FIG. 9, the protrusion 105 is provided between the protrusions 101*a* and 101*b*, which have different heights. The protrusion 105 is shorter in height and width than the protrusions 101*a* and 101*b*. The configuration of the transmission line is otherwise the same as the one shown in FIG. 8.

In this configuration, the same advantages as in the fifth embodiment can be obtained.

Figure 10:
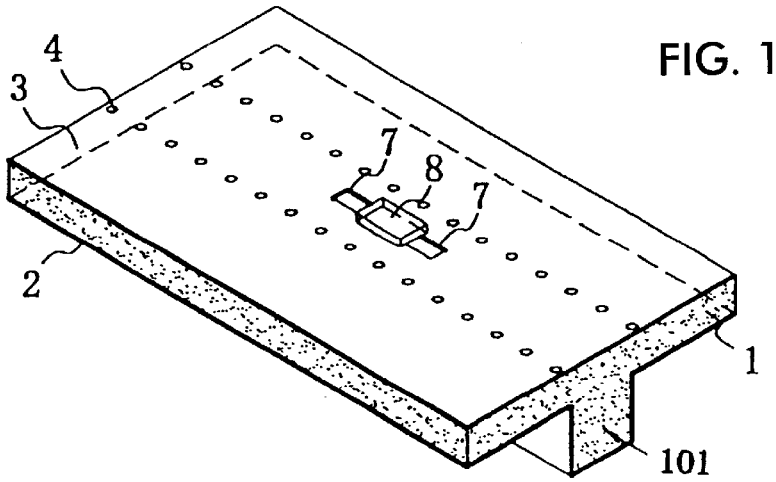
FIG. 10 is a perspective view of a modified transmission line which uses slot lines as its coupling lines instead of coplanar lines.

Although coplanar lines are used in the above-described embodiments, slot lines as shown in FIG. 10 may also be used. FIG. 10 shows a circuit arrangement that can be applied to any of the other embodiments of the invention.

FIG. 10 is a perspective view of a transmission line and shows the dielectric substrate 1, the lower-surface electrode 2, the upper-surface electrode 3, the through-holes 4, and a circuit arrangement comprising slits 7, and a circuit element 8.

Also, in any of the disclosed embodiments, a pattern (for example, a coplanar line, a slot line, and a microstrip line) can be formed on a dielectric film formed on another circuit substrate or on the upper-surface electrode, and the pattern can be mounted in a predetermined position on a surface of the dielectric substrate so as to be coupled to the transmission path formed by the protrusions.

Next, the configuration of a radar device will be described with reference to FIGS. 11 and 12, as an example of an integrated circuit and a transmitter-receiver using the same.

Figure 11:
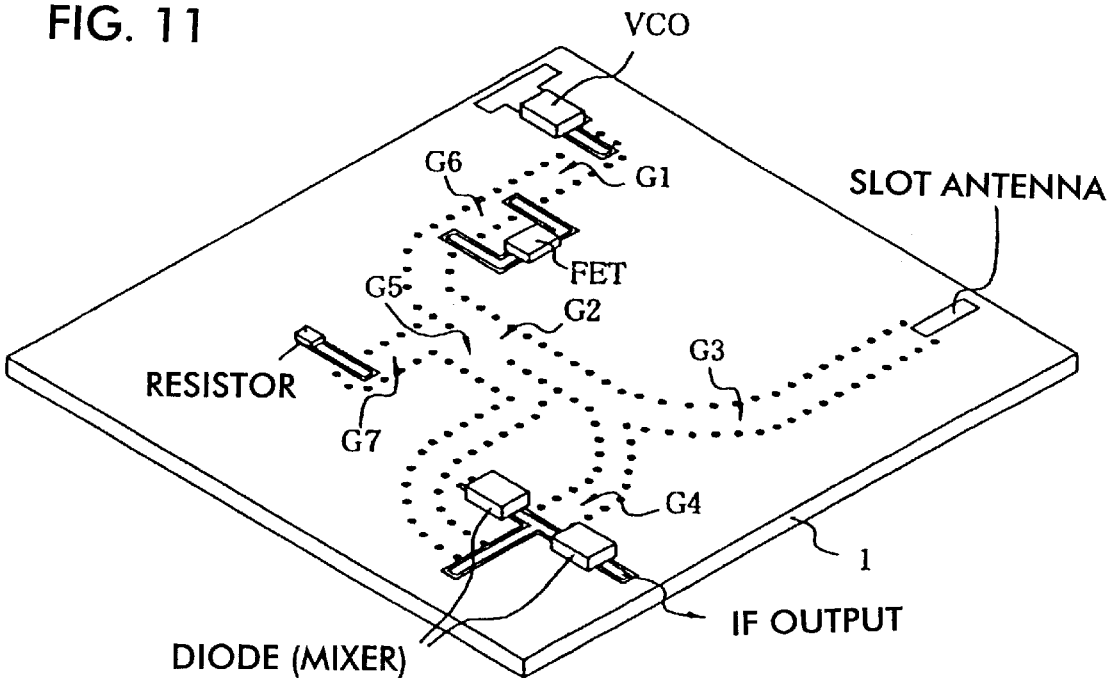
FIG. 11 is a perspective view of an integrated circuit including a dielectric substrate provided with a plurality of electronic components, viewed from the side of the electronic component mounting face.
Figure 12:
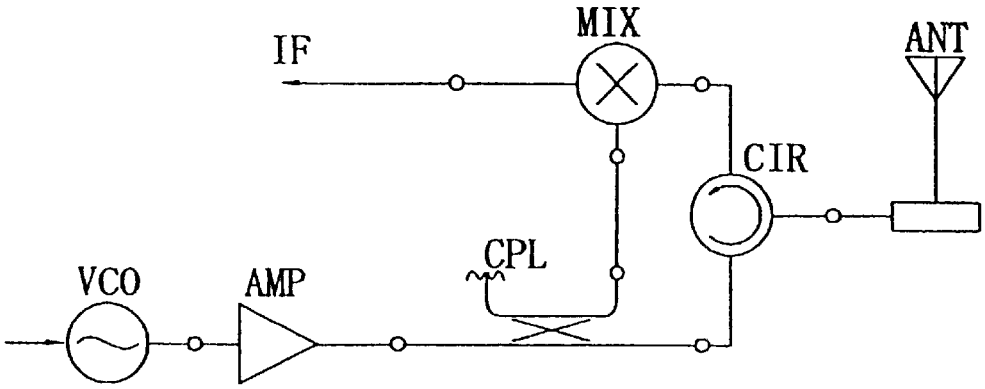
FIG. 12 shows an equivalent circuit of the integrated circuit shown in FIG. 11.

FIG. 11 is a perspective view of a dielectric substrate viewed from the side of the electronic component mounting face and FIG. 12 is an equivalent circuit thereof.

The dielectric substrate 1 has protrusions (not shown) which extend in line one after another on the lower surface thereof, electrodes on both surfaces thereof, and a plurality of through-holes aligned along the protrusions at both sides of the protrusions, thereby forming a transmission line.

Although the protrusions cannot be seen in FIG. 11 because the figure shows the side of the electronic component mounting face of the dielectric substrate 1, the transmission line can be seen from the alignment pattern of the through-holes. That is, six transmission lines, which are roughly indicated by G1, G2, G3, G4, G5, and G7, are formed. G6 is a portion for connecting G1 and G2, but no protrusion is formed on its lower surface.

In FIG. 11, a voltage-controlled oscillator (VCO) connected to a coplanar line is provided on the upper surface of the dielectric substrate 1. The coplanar line is coupled to the transmission line indicated by G1.

Between the transmission lines G1 and G2, an amplifier circuit including an FET connected by coplanar lines is provided. Herein, the lower surface opposite to the position of G6 between G1 and G2 has no protrusion, and thus a signal can be transmitted from G1 to G2 through the coplanar lines without leakage. Then, the signal amplified by the FET is transmitted from the coplanar line to G2.

Further, a slot antenna is provided at the end of the transmission line G3 and the slot antenna radiates a transmission signal in the direction perpendicular to the dielectric substrate 1.

The portion where the transmission lines G2 and G5 are close to each other constitutes a directional coupler. The signal, which is power-distributed by the directional coupler, is coupled as a local signal to a coplanar line to which one diode of a mixer circuit is connected. The other line G7 is coupled to a coplanar line and connected to a resistor, thereby functioning as a terminator of the directional coupler.

Also, a circulator (not shown) is provided at the branching point of a Y-shape constituted by the transmission lines G2, G3, and G4. The circulator is constituted by providing a resonator made of a circular ferrite plate and locating a permanent magnet for applying a static magnetic field in the direction perpendicular to the ferrite plate. The illustration of the circulator is omitted in FIG. 11. A reception signal from the slot antenna can be transmitted through the circulator and the transmission line G4, and is coupled to a coplanar line to which the other diode of the mixer circuit is connected. The two diodes in the mixer circuit function as a balanced mixer circuit and an IF signal is output to the external circuit.

FIG. 12 is a block diagram of the radar device. In FIG. 12, an oscillation signal from the VCO is amplified by the amplifier AMP and transmitted to the antenna ANT as a transmission signal via the directional coupler CPL and the circulator CIR. The reception signal from the circulator CIR and the local signal from the directional coupler CPL are transmitted to the mixer MIX and the mixer outputs an intermediate frequency signal IF.

As described above, by using a transmission line having excellent transmission characteristics, power efficiency is enhanced and a radar device having low power consumption and high detection sensitivity can be achieved.

Although a radar device is disclosed in the foregoing example, any communication device in which a transmission signal is transmitted to another communication device and a transmission signal is received from the other communication device can be configured in the same way.

Although the present invention has been described in relation to particular embodiments thereof, many other variations and modifications and other uses will become apparent to those skilled in the art. Therefore, the present invention is not limited by the specific disclosure herein.

What is claimed is:

1. A dielectric-waveguide-type transmission line comprising:

a dielectric substrate having two opposed main surfaces;

a plurality of protrusions aligned, one after another, on at least one main surface of the dielectric substrate;

electrodes formed on both main surfaces of the dielectric substrate and on outer surfaces of the protrusions;

a plurality of through-holes connecting the electrodes, the plurality of through holes being aligned along both sides of the protrusions, the protrusions functioning as a main transmission line;

an interrupting structure which divides the main transmission line into transmission line segments to interrupt a transmission signal; and a circuit which couples said transmission line segments separated by the interrupting structure, the circuit being provided on the other main surface of the dielectric substrate.

2. The transmission line according to claim 1, wherein the interrupting structure comprises a protrusion having a predetermined length and a height which is less than a height of the protrusions.

3. The transmission line according to claim 1, wherein the interrupting structure comprises a protrusion having a predetermined length and a width which is narrower than a width of the protrusions.

4. The transmission line according to claim 1, further comprising additional through-holes connecting the electrodes, the additional through-holes being provided in an area between two adjacent transmission line segments.

5. The transmission line according to claim 1, wherein a protrusion corresponding to one transmission line segment has a different height from another protrusion corresponding to an adjacent transmission line segment.

6. The transmission line according to claim 1, wherein the interrupting structure comprises a gap between two adjacent transmission line segments.

7. An integrated circuit comprising the transmission line according to claim 1, electronic components mounted on the other main surface of the dielectric substrate, said circuit being connected to said electronic components.

8. A transceiver comprising the integrated circuit according to claim 7, said integrated circuit being connected to at least one of a transmission circuit and a reception circuit.

9. A transceiver comprising the transmission line according to claim 1, said transmission line being connected to at least one of a transmission circuit and a reception circuit.

10. A dielectric-waveguide-type transmission line comprising:

a dielectric substrate having two opposed main surfaces;

a plurality of aligned protrusions on one main surface of the dielectric substrate, the protrusions functioning as a main transmission line;

electrodes formed on both main surfaces of the dielectric substrate and on outer surfaces of the protrusions;

a plurality of through-holes connecting the electrodes, the plurality of through holes being aligned along both sides of the protrusions;

an interrupting structure disposed between two adjacent protrusions which divides the main transmission line into transmission line segments to interrupt a transmission signal carried thereon; and a circuit which couples said transmission line segments divided by the interrupting structure, the circuit carrying said transmission signal between said segments.

11. The transmission line according to claim 10, wherein said circuit is disposed on the other main surface of the dielectric substrate.

12. The transmission line according to claim 10, wherein the interrupting structure comprises an additional protrusion having a predetermined length and a height which is less than a height of the two adjacent protrusions.

13. The transmission line according to claim 10, wherein the interrupting structure comprises an additional protrusion having a predetermined length and a width which is narrower than a width of the two adjacent protrusions.

14. The transmission line according to claim 10, further comprising additional through-holes connecting the electrodes, the additional through-holes being provided in an area between said two adjacent protrusions.

15. The transmission line according to claim 10, wherein a protrusion corresponding to one transmission line segment has a different height from another protrusion corresponding to an adjacent transmission line segment.

16. The transmission line according to claim 10, wherein the interrupting structure comprises a gap between two adjacent transmission line segments.

17. The transmission line according to claim 16, further comprising additional through-holes connecting the electrodes, the additional through-holes being provided in said gap.

18. An integrated circuit comprising the transmission line according to claim 10, electronic components mounted on the other main surface of the dielectric substrate, said circuit being connected to said electronic components.

19. A transceiver comprising the integrated circuit according to claim 18, said integrated circuit being connected to at least one of a transmission circuit and a reception circuit.

20. A transceiver comprising the transmission line according to claim 10, said transmission line being connected to at least one of a transmission circuit and a reception circuit.

* * * * *